United States Patent [19]

Wheeler

[11] 4,238,062

[45] Dec. 9, 1980

[54] CARRIER FOR GARMENT HANGERS

[76] Inventor: Raymond R. Wheeler, 95, Garden St., Kelso, Wash. 98626

[21] Appl. No.: 45,807

[22] Filed: Jun. 5, 1979

Related U.S. Application Data

[63] Continuation-in-part of Ser. No. 912,685, Jun. 5, 1978.

[51] Int. Cl.[3] ..... B65D 71/00

[52] U.S. Cl. ..... 224/45 T; 248/360

[58] Field of Search ..... 224/45 T, 45 P, 45 R, 224/42.46 A, 42.45 A; 24/241 SN, 236, 237, 232 R; 16/114, 125, 126, 110 R, DIG. 41; 248/308, 360

[56] References Cited

U.S. PATENT DOCUMENTS

| | | | |
|---|---|---|---|
| 1,580,590 | 4/1926 | Dow et al. | 24/232 |
| 1,635,975 | 7/1927 | Nardin | 24/232 |
| 2,239,798 | 4/1941 | Tinnerman | 16/114 R |
| 2,784,995 | 3/1957 | Hawkins | 16/114 R |
| 3,186,026 | 6/1965 | Serio | 224/45 P |
| 3,424,418 | 1/1969 | Freedman et al. | 224/42.45 A |
| 3,426,385 | 2/1969 | Gutshall | 16/114 R |
| 3,804,310 | 4/1974 | Wheeler | 224/45 T |

*Primary Examiner*—Stanley H. Tollberg
*Assistant Examiner*—Kenneth Noland
*Attorney, Agent, or Firm*—William A. Drucker

[57] ABSTRACT

A carrier for garment hangers has a saddle member with a recessed support surface bounded at one end by an end portion and adapted to receive hanger hooks side by side. A locking device carried by the saddle member is movable into a first position co-operating with the saddle to prevent removal of hooks, and a second position spaced sufficiently from the end portion to leave a gap permitting removal of the hanger hooks. The carrier also has a handle coupled to the saddle. In a preferred embodiment, there are two diametrically opposed support surfaces, and a common rotatable locking member cooperates with both such that hooks may only be removed from one of them at any one time.

7 Claims, 6 Drawing Figures

CARRIER FOR GARMENT HANGERS

This application is a continuation-in-part of my copending United States Patent Application Ser. No. 912685 filed June 5th 1978.

This invention relates to the carrying and supporting of garment hangers.

BACKGROUND OF THE INVENTION

The holding of several hanger hooks by use of the fingers is awkward and uncomfortable, particularly if a considerble weight of clothing is being carried. Further, removal or addition of hooks may cause the grasp to be lost on the hooks.

In my copending application referred to above there is disclosed a carrier for garment hangers comprising a saddle member which includes a recessed support surface adapted to receive a plurality of garment hanger hooks in side by side relationship, locking means carried by the saddle member and movable thereon into a first position in which to overlie the bearing surface to retain a hanger hook thereon, and a displaced position permitting free engagement and disengagement of a hanger hook, on and from the bearing surface, a handle, and means coupling the handle to the saddle member. It was found that, in use, the locking means when moved into its displaced position for removal of a hanger hook off one of two portions of the bearing surface, extending at 180° opposed positions, would inadvertently permit a hanger hook to slide off the other of the two portions of the bearing surface.

OBJECTS OF THE INVENTION

It is the main object of the present invention to provide an improved form of locking means, and in particular whereby when it is operated to permit removal of a hanger hook from one of two diametrically opposed bearing surfaces, nevertheless still remains in a locking position and prevents removal of a hanger hook from the other of the two opposed bearing surfaces.

A further object of the invention is to provide improvements whereby the carrier may be more readily manufactured with relatively simple elements which may be snap fitted together by resilient deformation and will remain permanently assembled without the use of fasteners.

SUMMARY OF THE INVENTION

According to the present invention, a carrier for garment hangers comprises:

(i) a saddle member which includes a recessed support surface bounded at an end by an end portion and adapted to receive a plurality of garment hanger hooks in side by side relationship, (ii) locking means carried by said saddle member and movable thereon into a first position in which it cooperates with said saddle member to prevent removal of a hanger hook, and into a second position in which it is spaced sufficiently from said end portion to permit removal thereover of a hanger hook, (iii) a handle, and (iv) means coupling the handle to the saddle member.

In a preferred form the recessed support surface extends to a radially outer end portion, the locking means being journalled with respect to the saddle member and having a peripheral recess which in said second position provides said spacing from said end portion.

In a preferred practical embodiment, the saddle member includes two of said recessed support surfaces extending in diametrically opposed positions. The locking means cooperates with the end portions of both of the support surfaces such that when the locking means is in said second position in relation to either of the support surfaces it prevents removal of a hanger hook from the other of said support surfaces.

Conveniently, said saddle member and/or said locking means is resiliently deformable, the locking means including other recessing serving to receive said radially outer end portion for locating said locking means removably in predetermined positions of rotation relative to said saddle member.

The means coupling the handle to the saddle member may comprise a sleeve on the saddle member and a shaft secured in the sleeve so as to be rotatable therein but prevented from axial movement, the handle being journalled in the shaft. By way of example, the shaft may have a portion of reduced diameter bounded at each axial end by a respective shoulder, the sleeve being engaged in that portion of reduced diameter by resilient deformation of the sleeve, and the sleeve abutting at each against a respective shoulder.

In a convenient construction for ease of assembly, the shaft includes a transverse bore having an internal circumferential recess. The handle includes a portion journalled in said bore and having an external peripheral bead to seat in said recess and lock the handle rotatably in said shaft.

DESCRIPTION OF THE PREFERRED EMBODIMENT

Figure 1:
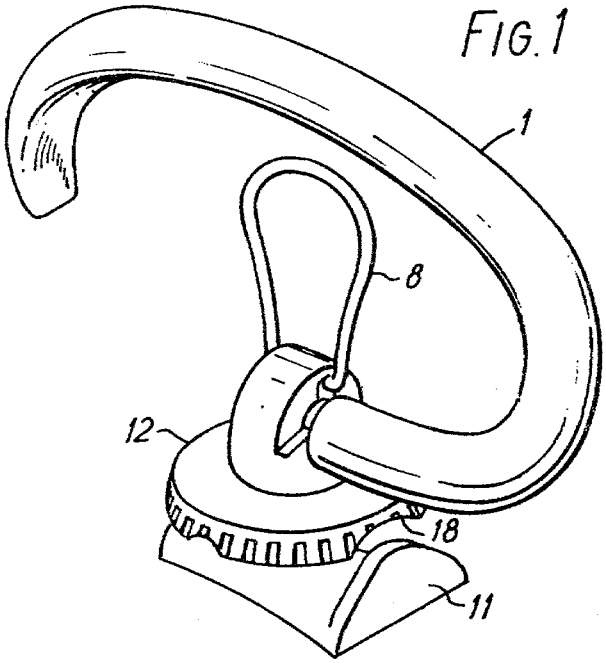
FIG. 1 is a perspective elevation of the carrier.
Figure 2:
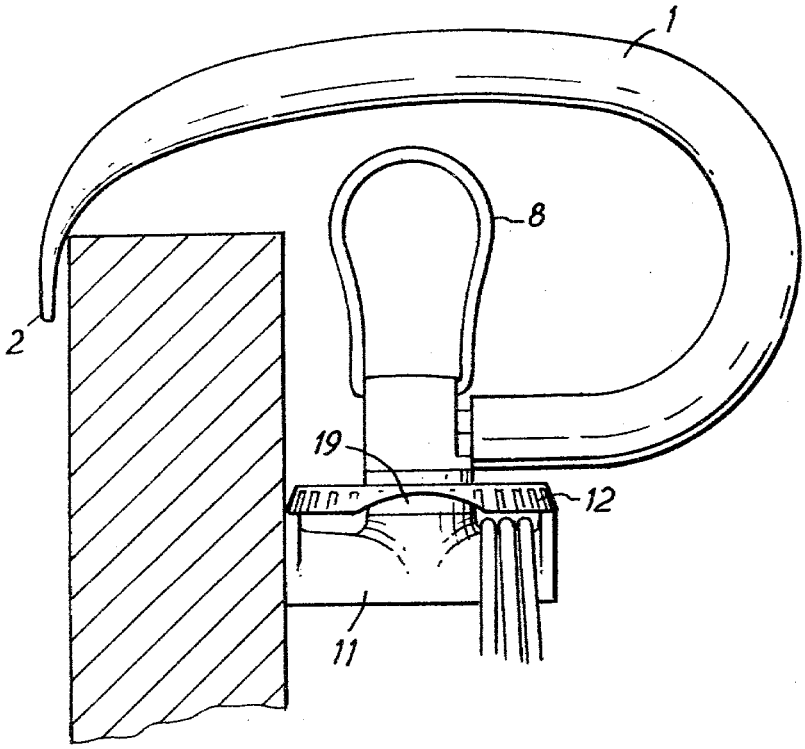
FIG. 2 is an elevation of the carrier with a plurality of hanger hooks thereon and seen mounted on a door.

The carrier comprises a C-shaped handle portion 1 having at one end an inturned tip 2. At its other end the handle portion is reduced in diameter to form a spigot 3 which is engaged in a bore 4 of a shaft 5 to act as a journal so that the handle portion may rotate about the axis of the spigot 3. The spigot 3 has a bead 3*a* which is a snap fit into a circumferential recess 4*a* to retain the handle portion in engagement, but rotatable, in the shaft 5.

In the upper part of the shaft 5 there is a transverse bore 6 which receives the inturned ends 7 of an eyelet 8 which can serve for supporting the hanger handle on a projection such as a mounting hook or a nail. The eyelet 8 can be swung through more than 180° by virtue of its ends 7, 7, serving as a journal in the bore 6. To facilitate engagement of the eyelet 8 by its ends 7, 7, into the bore 6, the shaft 5 is cut away at 9 to provide a channel extending upwardly from the bore 6. By spreading the ends 7,7 of the eyelet slightly, it can be slid longitudinally over the wall of the shaft 5 and then turned through 90° to be seated in the bore 4. The handle portion is then snapped into place and serves to retain the eyelet in place.

At its lower part, the shaft 5 is circumferentially recessed at 5*a* to receive a sleeve 10 forming part of a saddle 11. The lower end of the shaft 5 is curved, as at 5*b*, so that during assembly of the article the curved portion 5*b* can be forced into the upper end of the sleeve 10 and the two items pushed one into the other until the sleeve 10 becomes secured against axial movement by abutting at its upper end against a shoulder 5*d* of the shaft 5, and at its lower end against another shoulder 5*e* of the shaft 5. It will be understood that the shaft 5 and sleeve 10 are made of resiliently deformable material such as plastics.

Before the shaft 5 and sleeve 10 are forced into engagement, a locking wheel 12 is engaged in rotatable manner on the sleeve 10. Once the shaft 5 and sleeve 10 have been engaged together, the locking wheel 12 is itself captive, but rotatable.

Figure 3:
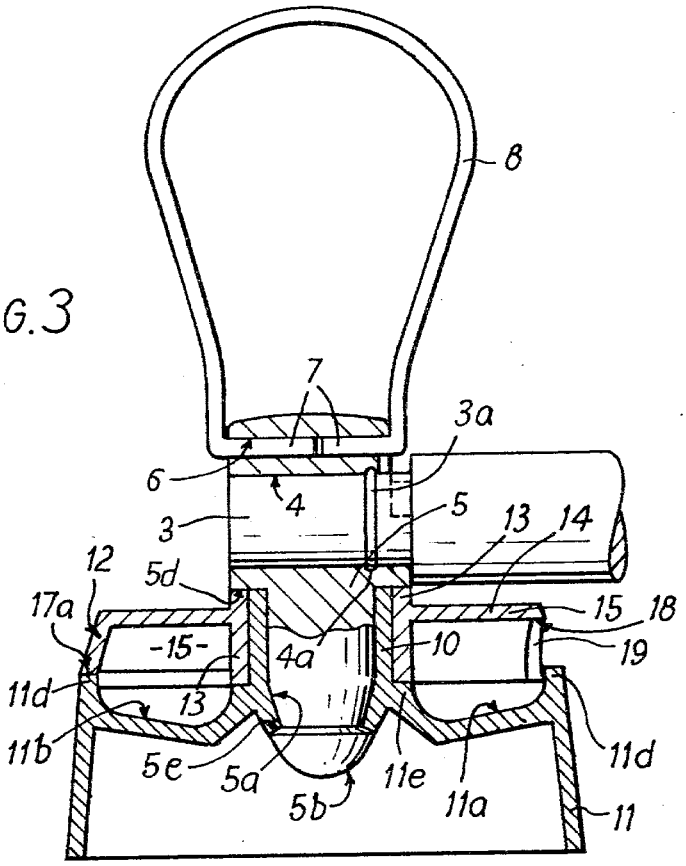
FIG. 3 is a section of part of the carrier on a larger scale.
Figure 4:
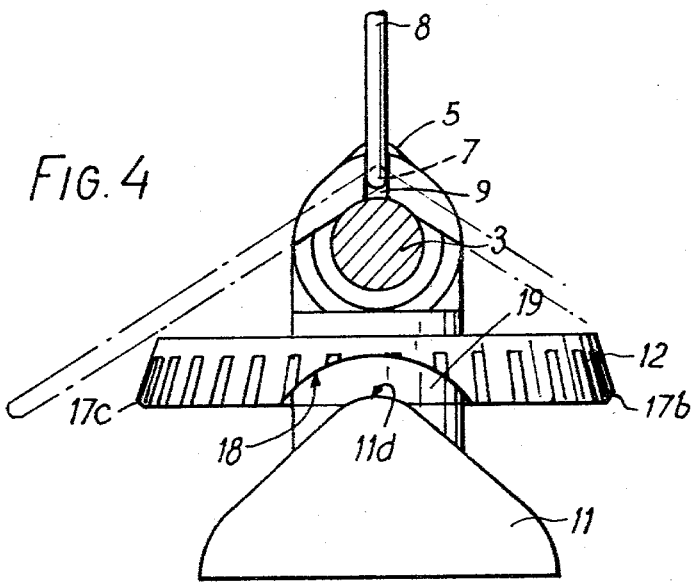
FIG. 4 is a partial side elevation.
Figure 5:
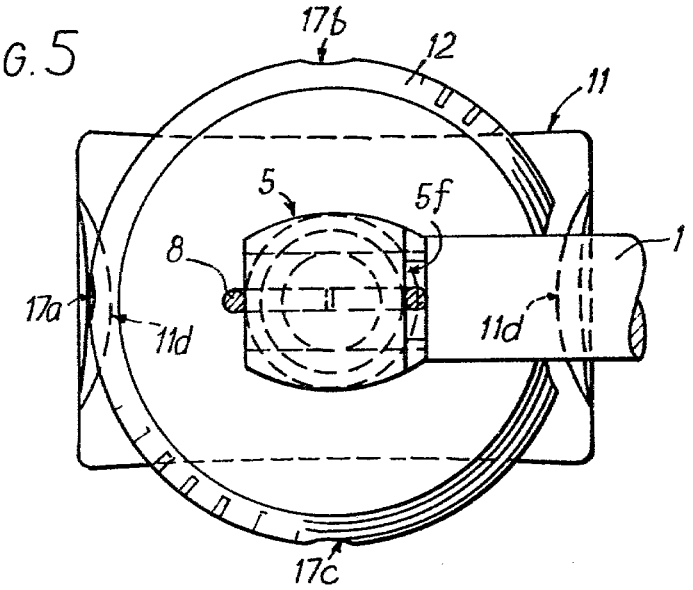
FIG. 5 is a partial plan view.

The saddle 11 has two support surfaces 11*a* and 11*b* extending radially in opposite directions, and which are curved (normal to the plane of FIG. 3) to receive the curved hook of the hanger, as will be best seen in FIGS. 1, 4 and 5. Each support surface slopes downwardly towards its radially inner end, so that hanger hooks resting thereon tend to slide towards the lowest point of the support surface, and thus the hanger hooks tend to pack neatly together instead of remaining spaced out along the support surface. At the radially outer end each support surface is bounded by an end stop 11*d* which has a curved upper surface as seen in FIG. 4. The inner end of each support surface is bounded by a shoulder 11*e*.

Figure 6:
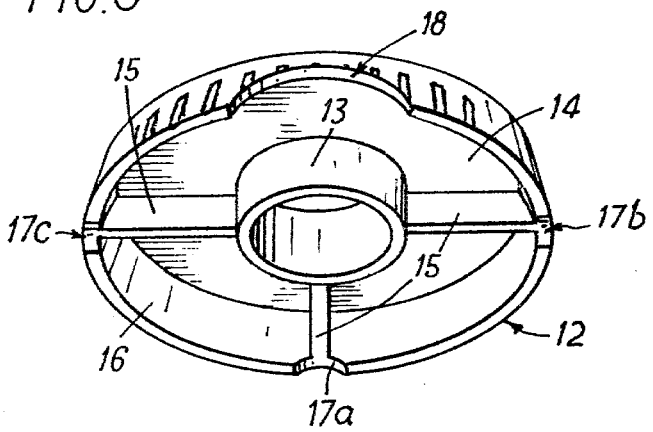
FIG. 6 is a perspective view, from below, of a locking-wheel.

Reference is now made to FIG. 6 which shows the detailed formation of the locking wheel 12. The wheel has a hub 13 which is journalled on the sleeve 10, an upper wall 14, a plurality of radial ribs 15, and a peripheral wall 16. In the lower edge of the wall 16 there are provided three minor recesses 17*a*, 17*b*, 17*c* and one major recess 18. The locking wheel can be placed in a position in which the diametrically opposite minor recesses 17*b* and 17*c* are each engaged onto the curved upper surface of a respective one of the two end stops 11*d* of the saddle. In this position of the locking wheel, any hanger hooks which are seated on the support surfaces 11*a* and 11*b* are thus held captive by the locking wheel.

The locking wheel 15 can be rotated through 90° in either direction so as to bring the major recess 18 into position over the corresponding end stop 11*d*, as seen in FIG. 4, thereby leaving a gap 19 for free passage of the hanger hook over the top of the end stop to disengage the hook entirely from the carrier. It will be appreciated that when the major recess is positioned to leave a gap 19 over one end stop 11*d*, the minor recess 17*a* is snugly engaged over the other end stop 11*d*, so that there is no possibility of hanger hooks inadvertently falling off the other support surface. After removal of the hanger hook or hooks, the locking wheel is again turned through 90° to bring the minor recesses 17*b*, 17*c* back into engagement with the end stops 11*d*. The saddle 11 and/or the locking wheel 12 are made of a resiliently deformable material, such as plastics, to enable the wheel to be moved into and out of locking condition. The locking wheel is held against axial movement on the shaft 5 by abutting, by the upper end of its hub 13, against the shoulder 5*d* of the shaft.

Referring to FIG. 4, the shaft 5 is seen to be cut away at one side to provide a plane face 5*f* to provide a clearance between the shaft 5 and the adjacent end of the handle portion 1 for movement of the eyelet 8 through more than 180°, to abut against a respective inclined stop face at each side.

The device as a whole consists of only five parts which can readily be assembled without fasteners and will remain permanently in assembly.

I claim:

1. A carrier for garment hangers comprising:

(i) a saddle member which includes a journal portion having an axis of rotation, and an axially recessed support surface extending to and bounded by a radially outer end portion and adapted to receive a plurality of garment hanger hooks in side by side relationship, (ii) a locking means journalled on said journal portion of the saddle member for rotation about said axis, said locking means including a first portion which in a first position of rotation lies adjacent said radially-outer end portion of the saddle to prevent passage of a garment hanger hook off said support surface over said saddle end portion, said locking means including a second portion which is angularly spaced from said first portion and which is recessed so as, in a second position of rotation, to be spaced sufficiently from said radially-outer end portion of said saddle to permit passage of a garment hanger hook off said support surface over said radially-outer end portion of said saddle, and said locking means being journalled about said saddle member such that said first and second portions of said locking means maintain a fixed axial distance from said radially-outer end portion of the saddle, and (iii) a handle coupled to the saddle member.

2. A carrier for garment hangers, as claimed in claim 1, wherein said saddle member includes two of said recessed support surfaces extending in diametrically opposed positions, and wherein said locking means cooperates with radially outer end portions of both said support. surfaces and wherein when the locking means is in said second position in relation to either of the support surfaces it prevents removal of a hanger hook from the other of said support surfaces.

3. A carrier for garment hangers, as claimed in claim 2, wherein at least one of said radially-outer end portions and said locking means is resiliently deformable, and wherein said locking means includes other recesses serving to receive one of said radially outer end portions for locating said locking means removably in predetermined positions of rotation relative to said saddle member.

4. A carrier for garment hangers, as claimed in claim 1, comprising a sleeve on the saddle member, and a shaft secured in said sleeve so as to be rotatable therein but prevented from axial movement, said handle being journalled in said shaft.

5. A carrier for garment hangers, as claimed in claim 4, wherein said shaft has a portion of reduced diameter bounded at each axisl end by a respective shoulder, said sleeve being engaged on said portion of reduced diameter by resilient deformation of said sleeve, said sleeve abutting at each end against a respective one of said shoulders.

6. A carrier for garment hangers, as claimed in claim 5, wherein said shaft includes a transverse bore having an internal circumferential recess, and wherein said handle includes a portion journalled in said bore and having an external peripheral bead to seat in said recess and lock said handle rotatably in said shaft.

7. A carrier, as claimed in claim 1, wherein said first portion of said locking means in said first position of rotation axially overlies said radially-outer end portion of said saddle member, and wherein said second portion of said locking means is axially recessed.

* * * * *